US007439922B2

(12) United States Patent
Autti

(10) Patent No.: US 7,439,922 B2
(45) Date of Patent: Oct. 21, 2008

(54) ANTENNA FOR A PORTABLE DEVICE

(75) Inventor: Marko Autti, Oulu (FI)

(73) Assignee: Nokia Corporation, Espoo (FI)

( * ) Notice: Subject to any disclaimer, the term of this patent is extended or adjusted under 35 U.S.C. 154(b) by 2 days.

(21) Appl. No.: 11/641,561

(22) Filed: Dec. 19, 2006

(65) Prior Publication Data

US 2008/0143631 A1 Jun. 19, 2008

(51) Int. Cl.
*H01Q 1/38* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,606,072 | B1 | 8/2003 | Hayward et al. | 343/767 |
| 6,980,155 | B2 * | 12/2005 | Lee et al. | 343/700 MS |
| 7,162,264 | B2 * | 1/2007 | Vance | 455/550.1 |
| 7,317,421 | B2 * | 1/2008 | Liu | 343/700 MS |
| 2005/0128162 | A1 | 6/2005 | Takagi et al. | 343/895 |
| 2007/0115200 | A1 * | 5/2007 | Ishimiya | 343/803 |

FOREIGN PATENT DOCUMENTS

| | | | |
|---|---|---|---|
| EP | 0538485 | A1 | 5/1992 |
| EP | 1182727 | A2 | 1/2001 |
| EP | 1280232 | A1 | 7/2002 |
| EP | 1403964 | | 9/2003 |
| EP | 1439605 | | 1/2004 |
| GB | 2301485 | | 12/1996 |

* cited by examiner

*Primary Examiner*—Hoang V Nguyen
(74) *Attorney, Agent, or Firm*—Ware, Fressola, Van Der Sluys & Adolphson, LLP

(57) ABSTRACT

A GPS antenna has two electrically connected L-sections disposed on opposite sides of a circuit board. The L-sections lie on two separate planes parallel to the circuit board surface. One L-section is connected to a feeding point located at one edge area of the circuit board and the other L-section is connected to a grounding point located at an opposite edge area of the circuit board. Optionally, a second grounding point is connected to the antenna element adjacent to the feeding point for impedance matching purposes. The antenna is configured for use in an electronic device such as a mobile phone.

19 Claims, 4 Drawing Sheets

ANTENNA FOR A PORTABLE DEVICE

FIELD OF THE INVENTION

The present invention generally relates to an antenna and, more specifically, relates to a GPS antenna for use in a portable device such as a mobile phone.

BACKGROUND OF THE INVENTION

The Global Positioning System (GPS) technology is already in mobile phones in the USA, as part of the E911 requirement, and it will be coming to mobile phones in other continents in the near future too, but probably more for navigational aids rather than emergency call positioning. The idea behind the E911 system in the USA is to provide the emergency services with your location data when you are phoning from a mobile phone, say for example, from the side of the road because your car has broken down. The mobile phone sends your precise location information (50-300 meters accuracy) to a local Public Safety Access Point (PSAP), including your mobile phone number. This enables the emergency services to send the correct services (for example, fire, police or ambulance/medical) and more importantly to the correct location. For navigational aids, it is a different matter, as the user is now using the product for recreational purposes rather than emergency situations. The product is then more likely to be used in the hand with the liquid crystal display (LCD) screen facing the user, whereas in an E911 usage scenario, the user will have the product against their head making a phone call, while also receiving GPS data. The operational modes for visual-based location applications and that for emergency positioning can therefore be quite different.

In GPS positioning, multipath signals are one of the major sources of errors for positioning accuracy, but this is not directly related to polarization losses or antenna performance. A GPS signal is right-hand circularly polarized (RHCP), and the polarization may change when the signal is reflected. Good location accuracy expects that the antenna has a clear view of the GPS satellites and a good RHCP radiation pattern toward the sky.

It is desirable to provide an antenna that can provide an omni-directional RHCP radiation pattern. While right-hand circular polarization alone is important, it is also of importance to have a GPS antenna which can be used when the product is held in the hand by the user, and when the product is held against the head during a phone call. In order to meet both of these product use cases we need an antenna design which can "see" satellites wherever and however the product is used by the user. This calls for an omni-directional radiation pattern, in other words, the antenna radiates in all directions from the product, and therefore is able to obtain a clear view of the GPS satellites, while maintaining the RHCP properties of the antenna. Traditional GPS receivers (not mobile phones) implement antennas which are RHCP, but have only hemispherical coverage, this means they can "see" the sky. If the product is tilted, then the antenna may see fewer satellites as a consequence. The other phenomena is that when the mobile phone is placed against the user's head in an E911 call, then the radiation pattern of the GPS antenna will be affected due to the presence of the head, and this can also lead to loss of satellites. Typically omni-directional antennas are linearly polarized, but in this invention both RHCP (circular polarization) and omni-directional radiation has been achieved. The antenna is a significant part of any radio communication system. Signal processing can not compensate for a poor antenna, especially in satellite communications. It is not exaggerated at all to say that the antenna is the key component in the GPS receiving system.

SUMMARY OF THE INVENTION

A GPS antenna has two electrically connected L-sections disposed on opposite sides of a circuit board. One L-section is connected to a feeding point located at one edge area of the circuit board and the other L-section is connected to a grounding point located at an opposite edge area of the circuit board. The antenna is configured for use in an electronic device such as a mobile phone.

Thus, the first aspect of the present invention is an antenna, comprising:

a feeding element;

a grounding element; and an electrically conductive element dimensioned for mounting on a circuit board, the circuit board having a first side and an opposing second side, wherein the conductive element comprises a first bent section disposed on the first side of the circuit board and a second bent section disposed on the second side of the circuit board, and wherein the first bent section has a first end and an opposing second end, the first end connected to the feeding element, and the second bent section has a first end and an opposing second end, the first end electrically connected to the second end of the first bent section and the second end connected to the grounding element.

Optionally, the antenna also comprises a further grounding element connected to the first bent section adjacent to the feeding element for impedance matching purposes, for example.

According to one embodiment of the present invention, the first end of the second bent section is electrically connected to the second end of the first bent section by an intermediate segment, and the first bent section has a first bending segment separating two substantially straight segments and the second bent section has a second bending segment separating two substantially straight segments, and wherein the first bending segment and the second bending segments are located on different sides of the intermediate segment.

In a circuit board having a first edge area and an opposing second edge area, the feeding element and the first bending segment are located in the first edge area, and the grounding element and the second bending segment are located in the second edge area.

According to one embodiment of the present invention, the two substantially straight segments of the first bent section comprise a first straight segment connected to the feeding element and a second straight segment connected to the intermediate segment, and the two substantially straight segments of the second bent section comprise a first straight segment connected to the intermediate segment and a second straight segment connected to the grounding element, wherein the first straight segment on the second bent section lies on an axis substantially parallel to the second straight segment on the first bent section.

Furthermore, the circuit board has a planar surface. The first bent section lies on a first plane substantially parallel to the planar surface, and the second bent section lies on a different second plane substantially parallel to the planar surface. For receiving a GPS signal, the antenna has an electric length substantially equal to half the wavelength of the GPS signal.

The second aspect of the present invention is an electronic device comprising an antenna configured to receive the global positioning system signal as described above. The electronic device can be a mobile terminal or the like.

The third aspect of the present invention is a method for making an antenna for receiving right-hand circularly polarized signals, such as the signals from a GPS system. The method comprises:

providing an electrically conductive element dimensioned for mounting on the circuit board, the electrically conductive element having a first section, a second section and an intermediate section joining the first and second sections;

bending the first section for forming a first L-shape section;

bending the second section for forming a second L-shape section;

locating the first L-shape section on the first side of the circuit board;

locating the second L-shape section on the second side of the circuit board such that one part of the intermediate section is located on the first side of the circuit board and another part of the intermediate section is located on the second side of the circuit board;

connecting a feeding element to the first section; and connecting a grounding element to the second section.

According to one embodiment of the present invention, the circuit board has a first edge area and an opposing second edge area, and wherein the feeding element is positioned in the first edge area; and the grounding element is positioned the ground element in the second edge area.

The present invention will become apparent upon reading the description taken in conjunction with FIGS. 1 to 4.

DETAILED DESCRIPTION OF THE INVENTION

Figure 1:
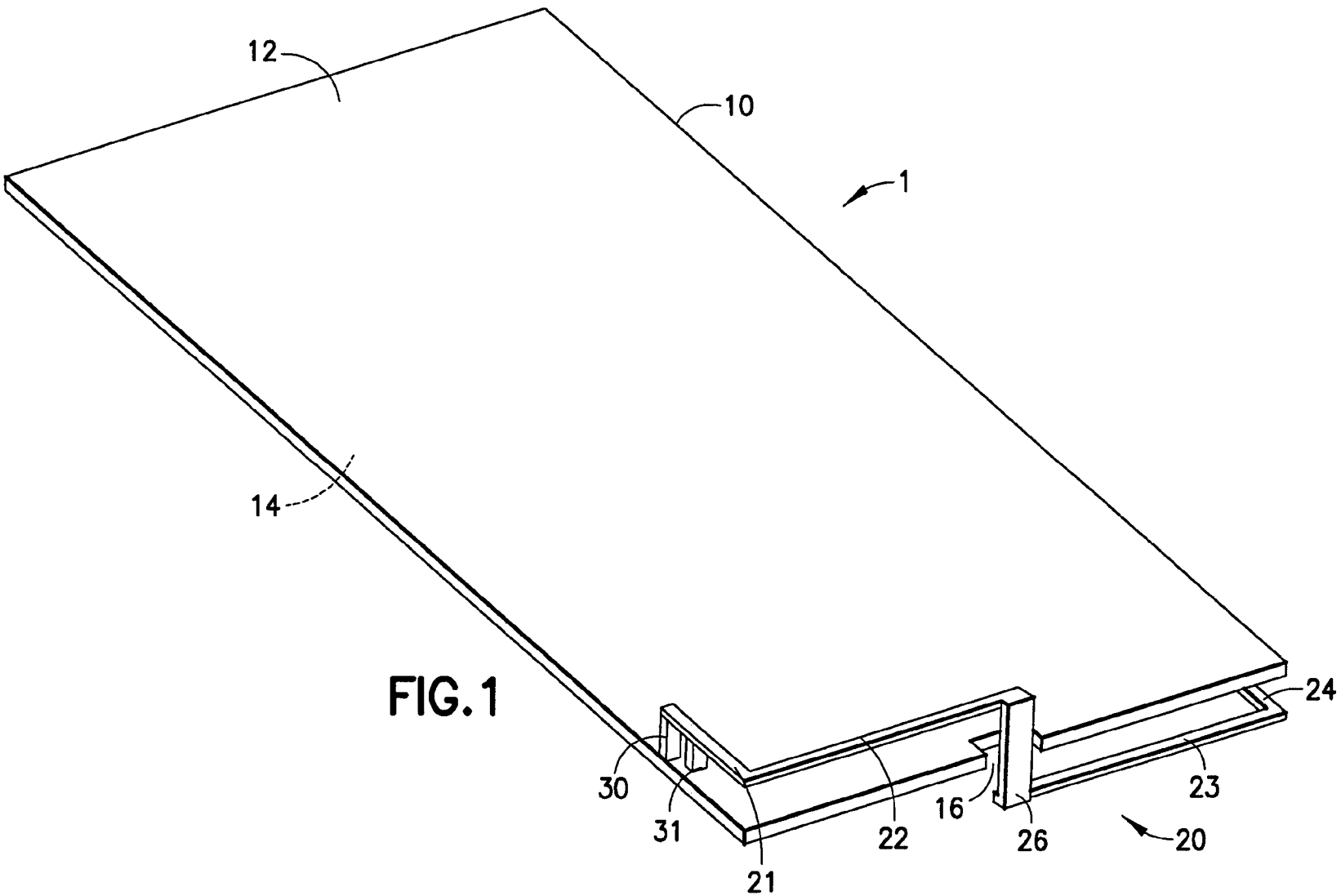
FIG. 1 is an isometric view of a PWB having an antenna, according to the present invention.

FIG. 1 is an isometric view of a PWB having an antenna, according to the present invention. As shown in FIG. 1, the antenna assembly 1 has a circuit board, such as a printed wire board (PWB) 10 having an antenna 20 mounted on one end of the PWB 10. The PWB 10 has a first side 12 and an opposing second side 14. On one end of the PWB 10, a notch 16 is made so as to allow the antenna 20 to loop through the PWB 10. As shown, the antenna 20 has a first bent section formed by antenna segments 21 and 22 disposed on the first side 12 and a second bent section formed by antenna segment 23 and 24 disposed on the second side 14. These two bent sections are joined by another antenna segment 26 at the notch 16. The first bent section has a feeding pin 30 and an optional grounding pin 31. The optional grounding pin 31 can be used for impedance matching, for example.

Figure 2:
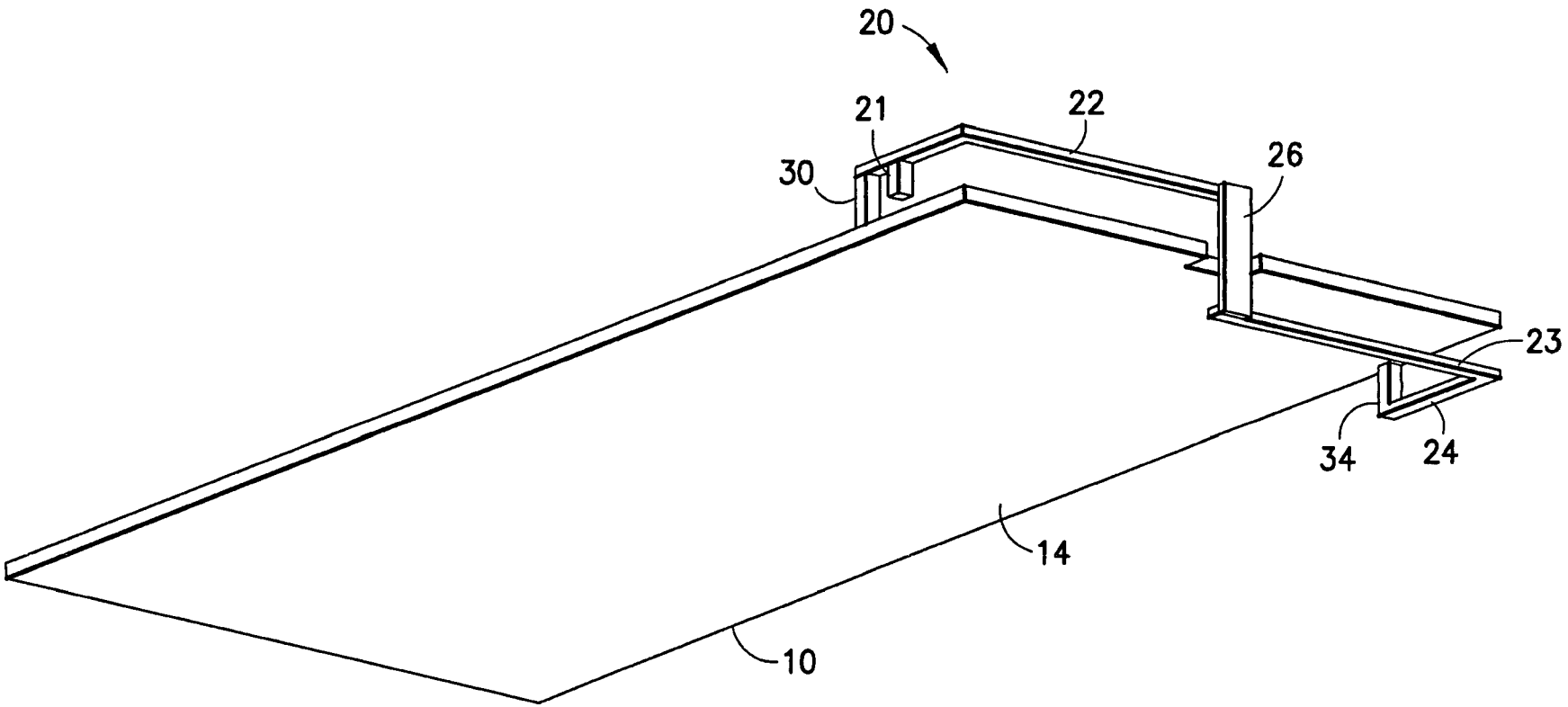
FIG. 2 is another isometric view of the PWB.
Figure 3:
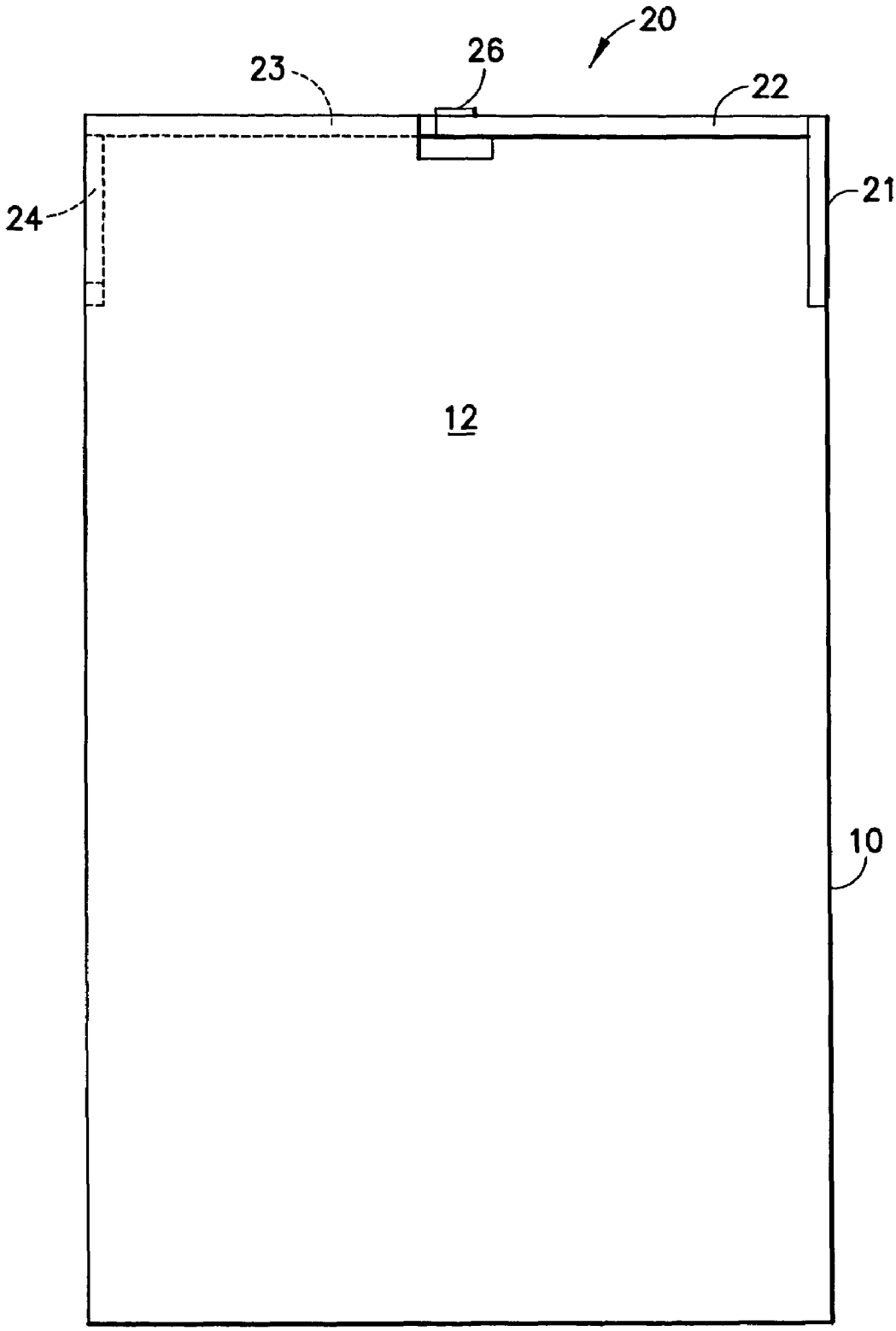
FIG. 3 is a plan view of the PWB.

Another isometric view is shown in FIG. 2 to show the second side 14 of the PWB 10. As shown in FIG. 2, the second bent section has a grounding pin 34. Each of the first and second bent sections is disposed at one corner of the PWB 10 and the bending angle is substantially equal to 90° degrees, as shown in FIG. 3. The total length of the antenna 20, including segments 21, 22, 23, 24 and 26 is substantially equal to half the wavelength of the GPS signal.

Figure 4:
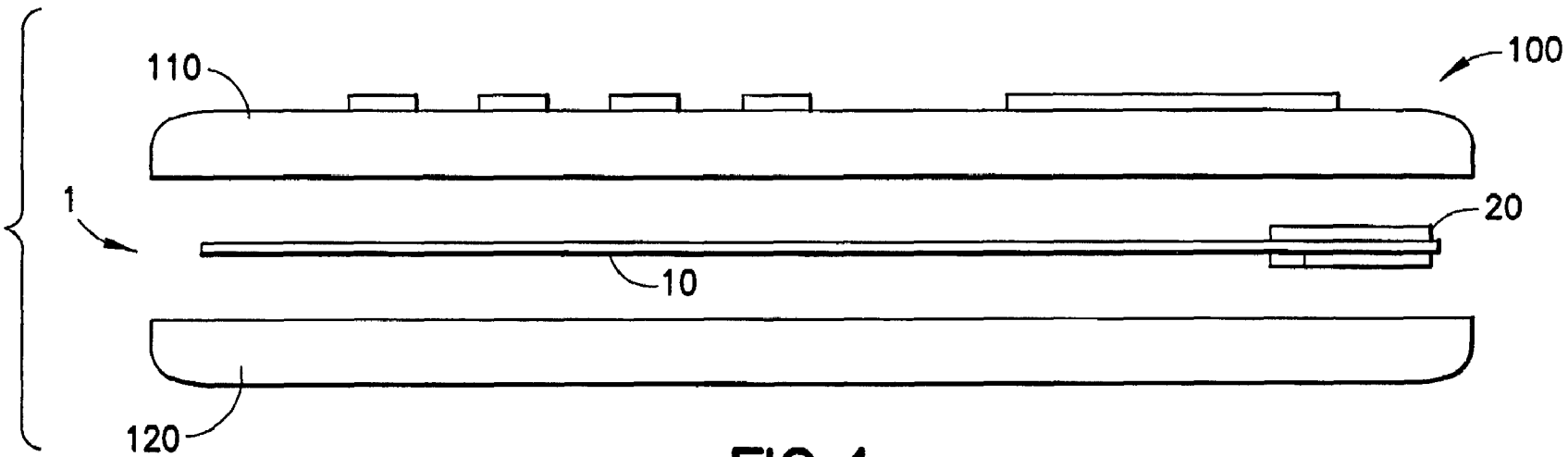
FIG. 4 is a schematic representation of a mobile phone having the GPS antenna, according to the present invention.

The GPS antenna 20, according to the present invention, can be installed in a small electronic device such as a mobile phone, a gaming console, an MP3 player, a personal digital assistant (PDA) device, a communicator device and the like. FIG. 4 is a schematic representation showing a mobile phone 100 having a first phone part 110 and a second phone part 120 to accommodate an antenna assembly 1 of the present invention.

In sum, the present invention provides an antenna having two L-shape sections located on different side of a circuit board for receiving right-hand circularly polarized signals. The antenna can be made on a circuit board as follows:

providing an electrically conductive element dimensioned for mounting on the circuit board, the electrically conductive element having a first section, a second section and an intermediate section joining the first and second sections;

bending the first section for forming a first L-shape section;

bending the second section for forming a second L-shape section;

locating the first L-shape section on the first side of the circuit board;

locating the second L-shape section on the second side of the circuit board such that one part of the intermediate section is located on the first side of the circuit board and another part of the intermediate section is located on the second side of the circuit board;

connecting a feeding element to the first section; and connecting a grounding element to the second section.

According to one embodiment of the present invention, the circuit board has a first edge area and an opposing second edge area, and wherein the feeding element is positioned in the first edge area; and the grounding element is positioned the ground element in the second edge area.

Optionally, a further grounding element is connected to the first section adjacent to the feeding element.

According to one embodiment of the present invention, the first L-shape section has a first segment and a second segment substantially perpendicular to the first segment, and the second L-shape section has a first segment substantially perpendicular to the first segment, and wherein one end of the intermediate section is connected to the second segment of the first L-shape section and another end of the intermediate section is connected to the first segment of the second L-shape section. The first and second L-shape sections are positioned so that the second segment of the first L-shape section is substantially parallel to the first segment of the second L-shape section. The first segment of the first L-shape section is positioned on the first edge area of the circuit board, and the second segment of the second L-shape section is positioned on the second edge area of the circuit board.

According one embodiment of the present invention, the circuit board has an opening, such as a notch on its edge, so as to allow the intermediate section to connect the first and second L-shape sections through the opening.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. An antenna comprising:

a feeding element;

a grounding element; and an electrically conductive element dimensioned for mounting on a circuit board, the circuit board having a thickness, a first side and an opposing second side separated by the thickness, wherein the conductive element comprises a first bent section disposed on the first side of the circuit board and a second bent section disposed on the second side of the circuit board, and wherein the first bent section has a first end and an opposing second end, the first end connected to the feeding element, and the second bent section has a first end and an opposing second end, the first end electrically connected to the second end of the first bent section and the second end connected to the grounding element.

2. The antenna of claim 1, wherein the circuit board has a first edge area and an opposing second edge area, and wherein the feeding element is located in the first edge area, and the grounding element is located in the second edge area.

3. The antenna of claim 2, further comprising a further grounding element connected to the first bent section adjacent to the feeding element.

4. The antenna of claim 1, wherein the first end of the second bent section is electrically connected to the second end of the first bent section by an intermediate segment and wherein the first bent section has a first bending segment separating two substantially straight segments and the second bent section has a second bending segment separating two substantially straight segments, and wherein the first bending segment and the second bending segments are located on different sides of the intermediate segment.

5. The antenna of claim 4, wherein the circuit board has a first edge area and an opposing second edge area, and wherein the first bending segment is located in the first edge area, and the second bending segment is located in the second edge area.

6. The antenna of claim 4, wherein the two substantially straight segments of the first bent section are substantially perpendicular to one another, and the two substantially straight segments of the second bent section are substantially perpendicular to one another.

7. The antenna of claim 4, wherein the two substantially straight segments of the first bent section comprise a first straight segment connected to the feeding element and a second straight segment connected to the intermediate segment, and the two substantially straight segments of the second bent section comprise a first straight segment connected to the intermediate segment and a second straight segment connected to the grounding element, wherein the first straight segment on the second bent section lies on an axis substantially parallel to the second straight segment on the first bent section.

8. The antenna of claim 4, wherein the circuit board has a planar surface, and wherein the first bent section lies on a first plane substantially parallel to the planar surface, and the second bent section lies on a different second plane substantially parallel to the planar surface.

9. The antenna of claim 1, wherein the antenna has an electric length substantially equal to half the wavelength of an operating frequency.

10. The antenna of claim 9, wherein the operating frequency comprises the frequency of a global positioning system signal.

11. An electronic device comprising an antenna configured to receive the global positioning system signal as defined in claim 9.

12. The electronic device of claim 11, comprising a mobile terminal.

13. An electronic device comprising an antenna according to claim 1.

14. A method for producing an antenna on a circuit board, the circuit board having a first side and an opposing second side separated by thickness of the circuit board, said method comprising:

providing an electrically conductive element dimensioned for mounting on the circuit board, the electrically conductive element having a first section, a second section and an intermediate section joining the first and second sections;

bending the first section for forming a first L-shape section;

bending the second section for forming a second L-shape section;

locating the first L-shape section on the first side of the circuit board;

locating the second L-shape section on the second side of the circuit board such that one part of the intermediate section is located on the first side of the circuit board and another part of the intermediate section is located on the second side of the circuit board;

connecting a feeding element to the first section; and connecting a grounding element to the second section.

15. The method of claim 14, wherein the circuit board has a first edge area and an opposing second edge area, said method further comprising:

positioning the feeding element in the first edge area; and positioning the ground element in the second edge area.

16. The method of claim 14, further comprising:

connecting a further grounding element to the first section adjacent to the feeding element.

17. The method of 14, wherein the first L-shape section has a first segment and a second segment substantially perpendicular to the first segment, and the second L-shape section has a first segment substantially perpendicular to the first segment, and wherein one end of the intermediate section is connected to the second segment of the first L-shape section and another end of the intermediate section is connected to the first segment of the second L-shape section, said method further comprising:

positioning the first and second L-shape sections so that the second segment of the first L-shape section is substantially parallel to the first segment of the second L-shape section.

18. The method of claim 17, wherein the circuit board has a first edge area and an opposing second edge area, said method further comprising:

positioning the first segment of the first L-shape section on the first edge area, and positioning the second segment of the second L-shape section on the second edge area.

19. The method of claim 14, further comprising:

providing an opening on the circuit board so as to allow the intermediate section to connect the first and second L-shape sections through the opening.

* * * * *